US007591552B2

(12) United States Patent
Takeshita et al.

(10) Patent No.: US 7,591,552 B2
(45) Date of Patent: Sep. 22, 2009

(54) LIQUID EJECTING APPARATUS

(75) Inventors: Sanshiro Takeshita, Nagano-ken (JP); Eiichi Miyashita, Nagano-ken (KR)

(73) Assignee: Seiko Epson Corporation, Tokyo (JP)

( * ) Notice: Subject to any disclaimer, the term of this patent is extended or adjusted under 35 U.S.C. 154(b) by 344 days.

(21) Appl. No.: 11/336,598

(22) Filed: Jan. 20, 2006

(65) Prior Publication Data

US 2006/0170750 A1 Aug. 3, 2006

(30) Foreign Application Priority Data

Jan. 20, 2005 (JP) ..... 2005-012673
Jan. 20, 2005 (JP) ..... 2005-012677

(51) Int. Cl.
*B41J 2/01* (2006.01)

(52) U.S. Cl. ..... 347/104; 346/134; 347/20; 347/29; 347/37; 347/220; 400/619; 400/648

(58) Field of Classification Search ..... None
See application file for complete search history.

(56) References Cited

U.S. PATENT DOCUMENTS

| | | | | |
|---|---|---|---|---|
| 5,339,280 | A * | 8/1994 | Goldberg et al. | 346/134 |
| 5,351,228 | A * | 9/1994 | Kanno et al. | 720/647 |
| 5,521,627 | A * | 5/1996 | Keung et al. | 347/220 |
| 6,550,907 | B2 * | 4/2003 | Uchida | 347/104 |
| 7,222,955 | B2 * | 5/2007 | Ohashi et al. | 347/104 |
| 2002/0126192 | A1 * | 9/2002 | Kawaguchi et al. | 347/104 |
| 2003/0234852 | A1 * | 12/2003 | Oshima et al. | 347/104 |
| 2005/0093953 | A1 * | 5/2005 | Miyake et al. | 347/104 |
| 2006/0181566 | A1 * | 8/2006 | Miyashita et al. | 347/20 |

FOREIGN PATENT DOCUMENTS

| | | |
|---|---|---|
| EP | 1 389 535 A1 | 2/2004 |
| JP | 2004-63852 | 3/2001 |
| JP | 2003-211757 | 7/2003 |
| JP | 2004-42382 | 2/2004 |
| JP | 2004-43095 | 2/2004 |
| JP | 2004-106344 | 4/2004 |
| JP | 2004-130774 | 4/2004 |

OTHER PUBLICATIONS

European Search Report dated Jul. 5, 2006.

* cited by examiner

*Primary Examiner*—Matthew Luu
*Assistant Examiner*—John P Zimmermann
(74) *Attorney, Agent, or Firm*—Nutter McClennen & Fish LLP; John J. Penny, Jr.

(57) ABSTRACT

A liquid ejecting apparatus comprising a transporting path to transport a first target medium in a first direction and to transport a second target medium in the first direction and a second direction, a first and second rollers, a supporting member that supports the second roller and is movable between a first position where the first roller contacts the second rollers and a second position where the second roller is separated from the first roller, a releaser that moves the supporting member between the first and second positions, wherein the releaser has a lever that projects into the transporting path when the supporting member is in the first position and is adapted to be pushed by a leading edge of the second target medium, thereby receding from the transporting path and rotating the releaser such that the releaser moves the supporting member to the second position.

13 Claims, 15 Drawing Sheets

LIQUID EJECTING APPARATUS

BACKGROUND OF THE INVENTION

The present invention relates to a liquid ejecting apparatus for ejecting liquid droplets to a target medium, and more particularly, to a liquid ejecting apparatus configured to be able to transport a plate-shaped member such as a tray on which a disk-shaped target medium is mounted.

The liquid ejecting apparatus is not limited to a recording apparatus, such as a printer, a copier, or a facsimile, which employs an ink jet recording head and ejects ink from the recording head to a recording medium, to thus effect recording. The liquid ejecting device is employed to encompasses an apparatus that ejects a liquid appropriate to an application, in place of ink from a liquid ejecting head corresponding to the ink jet recording head onto a target medium corresponding to a recording medium, thereby causing the liquid to adhere to the medium.

In addition to the recording head, the liquid ejecting head encompasses a coloring material ejecting head used for manufacturing a color filer such as a liquid-crystal display or the like; an electrode material (conductive paste) ejecting head used for forming electrodes, such as an organic EL display or a field emission display (FED) or the like; a bio-organic substance ejecting head used for manufacturing a bio-chip; a sample ejecting head serving as a precision pipette; and the like.

Some of ink jet printers, which are examples of the recording apparatus or liquid ejecting apparatus, are configured to be able to take as a recording medium an optical disk, or the like, which is typified by a CD-R or a DVD (Digital Versatile Disc) or the like, and to eject ink droplets onto a print face of the recording medium. As described in, e.g., Japanese Patent Publication Nos. 2004-106344A and 2003-211757A, an optical disk is generally set, in such an ink jet printer, on a plate-shaped tray. The optical disk is transported along a transporting path in the ink jet printer while remaining set on the tray. The label face is subjected to ink jet recording.

Incidentally, an ejector disposed downstream of a recording section has an ejecting roller to be rotationally driven and an ejecting follower roller which is rotationally driven while remaining in contact with the ejecting roller. In order to prevent occurrence of a white patch of ink or transfer of ink, the ejecting follower roller adopts a spur roller having a plurality of teeth provided over an outer periphery of the roller However, some of the optical disks have a data storage area located immediately below the label face of the optical disk. When the ejecting follower roller (the spur roller) comes into contact with the label face of such an optical disk, there may arise a case where damage is inflicted on the data storage area located immediately below the label face.

Therefore, in an ink jet printer configured to be able to subject a label face of an optical disk, or the like, directly to ink jet recording, the ejecting follower roller is configured to retractably come into contact with the ejecting roller, as described in Japanese Patent Publication Nos. 2004-130774A, 2004-42382A, and 2003-211757A. When the label face of the optical disk is subjected to ink jet recording operation, the ejecting follower roller is configured to be retracted from the ejecting roller (i.e., the label face of the optical disk).

However, each of the above ink jet printers has been desired to be enhanced in view of the points provided below.

First, a recording apparatus described in Japanese Patent Publication No. 2004-130774A is configured such that a frame supporting the ejecting follower roller is joined to an ejected sheet stacker by a link mechanism. The frame (the ejecting follower roller) is vertically actuated in accordance with operation for switching the position of the ejected sheet stacker. Accordingly, as a result of adoption of such a link mechanism, the configuration has become likely to incur a cost hike associated with an increase in the number of parts.

Second, a recording apparatus described in Japanese Patent Publication No. 2004-42382A is configured such that an attachment (an optical disk transporter) is removably attached to a main body of the recording apparatus, and such that the ejecting follower roller is caused to retract from the ejecting roller by actuating a slide cover forming the attachment. Accordingly, a cost hike associated with an increase in the number of parts is likely to be incurred, and a predetermined operation must be performed. For these reasons, the recording apparatus cannot always be said to be user-friendly.

Third, a recording apparatus described in Japanese Patent Publication No. 2003-211757A is configured such that, when the tray member on which an optical disk is mounted is set in the recording apparatus, the tray member pushes by itself a release roller provided on a frame provided with the ejecting follower roller ascends. This configuration enables reliable release of the ejecting follower roller without involvement of a special operation, but involves a disadvantage of the inability to ensure a large release stroke of the frame. In order to retain the frame in a retracted position in a stable state (posture), placing a plurality of release rollers in the widthwise direction of the tray member is desirable. However, the release rollers obstruct an ejection of a cut sheet and, hence, must be disposed outside the transporting path of the cut sheet. Consequently, when the release rollers are provided on both sides of the transporting path of the cut sheet, the width of the tray member must be increased correspondingly.

In addition to the above-described problems, problems such as those provided below are also encountered. In the ink jet printer, the recording medium is transported by a transporter provided upstream of an ink jet recording head. The tray member on which the optical disk is set is also transported by the transporter as described in Japanese Patent Publication No. 2004-106344A or Japanese Patent Publication No. 2003-211757A.

The transporter is formed by comprising a transporting roller to be rotationally driven and a transporting follower roller which is rotationally driven while remaining in contact with the transporting roller. However, the transporting follower roller is provided so as to come into press contact with the transporting roller in order to ensure a high accuracy of transport during transport of the recording medium, such as a cut sheet. When the transporting follower roller comes into press contact with the label face of the optical disk set on the tray at the time of the tray being transported by the transporter of the above configuration, there may be a risk of a passage trace of the ejecting follower roller being formed on the label face.

SUMMARY OF THE INVENTION

It is therefore an object of the invention to provide, at low cost, a user-friendly liquid ejecting apparatus wherein an ejection follower roller can be retracted from a label face of an optical disk without a special operation and size increasing of a tray member mounting the optical disk.

It is also an object of the invention to provide a liquid ejecting apparatus capable of preventing a passage trace of an ejecting follower roller from being formed on a label face of an optical disk mounted on a tray member, whereby maintaining a superior recording result.

In order to achieve the above objects, according to the invention, there is provided a liquid ejecting apparatus, comprising:

a transporting path, adapted to transport a first target medium in a first direction, and to transport a second target medium in the first direction and a second direction opposite to the first direction;

a liquid ejecting head, adapted to eject liquid droplets toward the first target medium and the second target medium;

a first roller and a second roller, disposed in a downstream side of the liquid ejecting head relative to the first direction, and adapted to nip the first target medium therebetween;

a supporting member, supporting the second roller and movable between a first position at which the second roller comes in contact with the first roller and a second position at which the second roller is separated from the first roller; and a releaser, rotatably supported on the supporting member and operable to move the supporting member between the first position and the second position in accordance with the rotation thereof, the releaser comprising a lever which is projected into the transporting path when the supporting member is placed in the first position, wherein the lever is adapted to be pushed by a leading edge of the second target medium transported in the second direction, thereby receding from the transporting path and rotating the releaser in a such a direction that the releaser moves the supporting member to the second position.

With this configuration, since the supporting member is displaced to the second position by rotation of the releaser, a large release stroke of the supporting member can be ensured. Cost-reduction can be achieved without involvement of an increase in the number of components as in the case of adoption of a link mechanism. As a result of the second target medium being inserted into the transporting path, the second roller is reliably dissociated from the first roller without involvement of a necessity for a special operation. Hence, the user-friendly configuration can be attained.

The liquid ejecting apparatus may further comprise an urging member, which urges the releaser so as to rotate in such a direction that the releaser moves the supporting member to the first position.

With this configuration, when the second target medium is transported in the first direction (ejected), the lever acts so as to push the leading edge of the second target medium in the first direction. Consequently, the second target medium can be ejected smoothly.

The releaser may comprise at least one pressing member adapted to press the second target medium toward the first roller when the supporting member is placed in the second position.

With this configuration, lifting of the second target medium can be prevented, and the second target medium can be reliably prevented from contacting the separated second roller.

The press member may be a roller.

With this configuration, the second target medium can be smoothly transported without involvement of infliction of load.

A plurality of press members may be arranged in a third direction perpendicular to the first direction and the second direction, so as to be symmetrical with a center of the second target medium relative to the third direction.

With this configuration, the second target medium can be appropriately transported without being skewed.

The press member may project toward the transporting path when the lever recedes from the transporting path, and may recede from the transporting path when the lever project toward the transporting path.

With this configuration, the second target medium can be reliably prevented from contacting the separated second roller.

The press member may be disposed at an area in which the first target medium passes when the lever projects into the transporting path.

With this configuration, an increase in the dimension of the second target medium in the third direction can be prevented. In addition, passage of the first target medium is not obstructed.

The releaser may comprise a regulator, which regulates an attitude of the supporting member to be horizontal.

The upstream side of the supporting member relative to the first direction is used as an operation area of the liquid ejection head. When the supporting member assumes an inclined attitude in such a case, the upper end portion of the supporting member becomes prone to interfere with the operation of the liquid ejecting head. However, with the above configuration, the upper side edge section of the supporting member hardly Interferes with the operation of the liquid ejecting head. Therefore, there is no necessity for operation of greatly separating the supporting member from the liquid ejecting head, thereby preventing an increase in the size of the apparatus.

The regulator may comprise a positioning member having a stopper face facing the supporting member, and a projection provided on the supporting member projecting toward the stopper face. In this case, the projection is abutted against the stopper face, thereby defining the second position of the supporting member.

With this configuration, the supporting member can be retained in the second position with a simple configuration.

The regulator may comprise an urging member which urges the projection toward the stopper face.

With this configuration, the supporting member can be retained at the second position in a more stable manner.

The releaser may be disposed in a downstream side of the second roller relative to the first direction.

With this configuration, when there is adopted a configuration for inserting the second target medium from a downstream side of the second roller relative to the first direction, the second target medium can be prevented from contacting the separated second roller.

The liquid ejecting apparatus may further comprise a stopper which prevents the second target medium from entering the transporting path when the supporting member is placed in the first position.

With this configuration, there can be prevented occurrence of a problem of the second target medium contacting the second roller as a result of the second target medium being inserted from an inappropriate position (e.g., a position where the second target medium is not brought into contact with the lever).

The second target medium may be transported while being mounted on a tray.

With this configuration, a label face of an optical disk or the like can be subjected to the liquid ejection as the second target medium.

According to the invention, there is also provided a liquid ejecting apparatus, comprising:

a transporting path, adapted to transport a first target medium in a first direction, and to transport a tray in the first direction and a second direction opposite to the first direction, the tray having a first face on which a second target medium is mounted and a second face opposite to the first face;

a liquid ejecting head, adapted to eject liquid droplets toward the first target medium and the second target medium;

a first roller, adapted to come in contact with the second face of the tray; and a second roller, adapted to come in contact with the first face of the tray so as to avoid the second target medium.

With this configuration, a passage trace of the second roller for transporting the tray is prevented from being left on the second target medium, so that a condition of the second target medium obtained by the liquid ejection can be maintained. In addition, if the second roller were passed over the second target medium, there may arise a case where the accuracy of transport of the tray is adversely affected as a result of the second roller passing over the steps at the boundary between the tray and the second target medium. However, with the above configuration, occurrence of a drop in the accuracy of transport, such as that mentioned previously, can be prevented.

The first roller and a third roller may be disposed in a downstream side of the liquid ejecting head relative to the first direction, and are adapted to nip the first target medium therebetween and to eject the first target medium toward an outside of the liquid ejecting apparatus. The liquid ejecting apparatus may further comprise a releaser, operable to move the third roller between a first position at which the third roller comes in contact with the first roller and a second position at which the third roller is separated from the first roller. In this case, the second roller projects into the transporting path to press the second target medium toward the first roller when the third roller is placed in the second position.

With this configuration, the tray is transported by the first roller and the second roller disposed in the downstream side of the liquid ejecting head relative to the first direction. Namely, the third roller for transporting the first target medium is not utilized. Therefore, the force used for nipping the tray can be readily optimized. Consequently, infliction of damage on the tray, which would otherwise be caused by forcefully nipping the tray, can be prevented. Moreover, since a leading end portion of the tray does not need to be nipped by the first roller and the third roller during the liquid ejecting operation, the dimension of the leading end portion of the tray can be reduced, and an attempt can be made to miniaturize the tray.

The first roller and a third roller may be disposed in a downstream side of the liquid ejecting head relative to the first direction, and are adapted to nip the first target medium therebetween and to eject the first target medium toward an outside of the liquid ejecting apparatus. The liquid ejecting apparatus may further comprise: a supporting member, supporting the third roller and movable between a first position at which the third roller comes in contact with the first roller and a second position at which the third roller is separated from the first roller; and a releaser, rotatably supported on the supporting member and operable to move the supporting member between the first position and the second position in accordance with the rotation thereof, the releaser comprising a lever which is projected into the transporting path when the supporting member is placed in the first position. In this case, the lever is adapted to be pushed by a leading edge of the second target medium transported in the second direction, thereby receding from the transporting path and rotating the releaser in a such a direction that the releaser moves the supporting member to the second position.

With this configuration, the supporting member is displaced to the second position by rotation of the releaser. Accordingly, a large release stroke of the supporting member can be ensured. Cost-reduction can be achieved without involvement of an increase in the number of components as in the case of adoption of a link mechanism. As a result of the second target medium being inserted into the transporting path, the second roller is reliably separated from the first roller without Involvement of a necessity for a special operation. Hence, user-friendly configuration can be attained.

The first roller and the second roller may be disposed in an upstream side of the liquid ejecting head relative to the first direction, and are adapted to nip the first target medium therebetween. In this case, the liquid ejecting apparatus may further comprise a releaser, operable to move the second roller between a first position at which the second roller comes in contact with the first roller and a second position at which the second roller is separated from the first roller.

With this configuration, a high degree of transport accuracy can be achieved at the time of transport of the tray. In general, such a first roller may be formed from a metal shaft element. Hence, the tray having a rigid body can be transported by the first roller having high strength. Therefore, durability of the apparatus can be enhanced.

BRIEF DESCRIPTION OF THE DRAWINGS

The above objects and advantages of the present invention will become more apparent by describing in detail preferred exemplary embodiments thereof with reference to the accompanying drawings, wherein.

DESCRIPTION OF THE EMBODIMENTS

Embodiments of the invention will be described below in detail with reference to the accompanying drawings.

Figure 2:
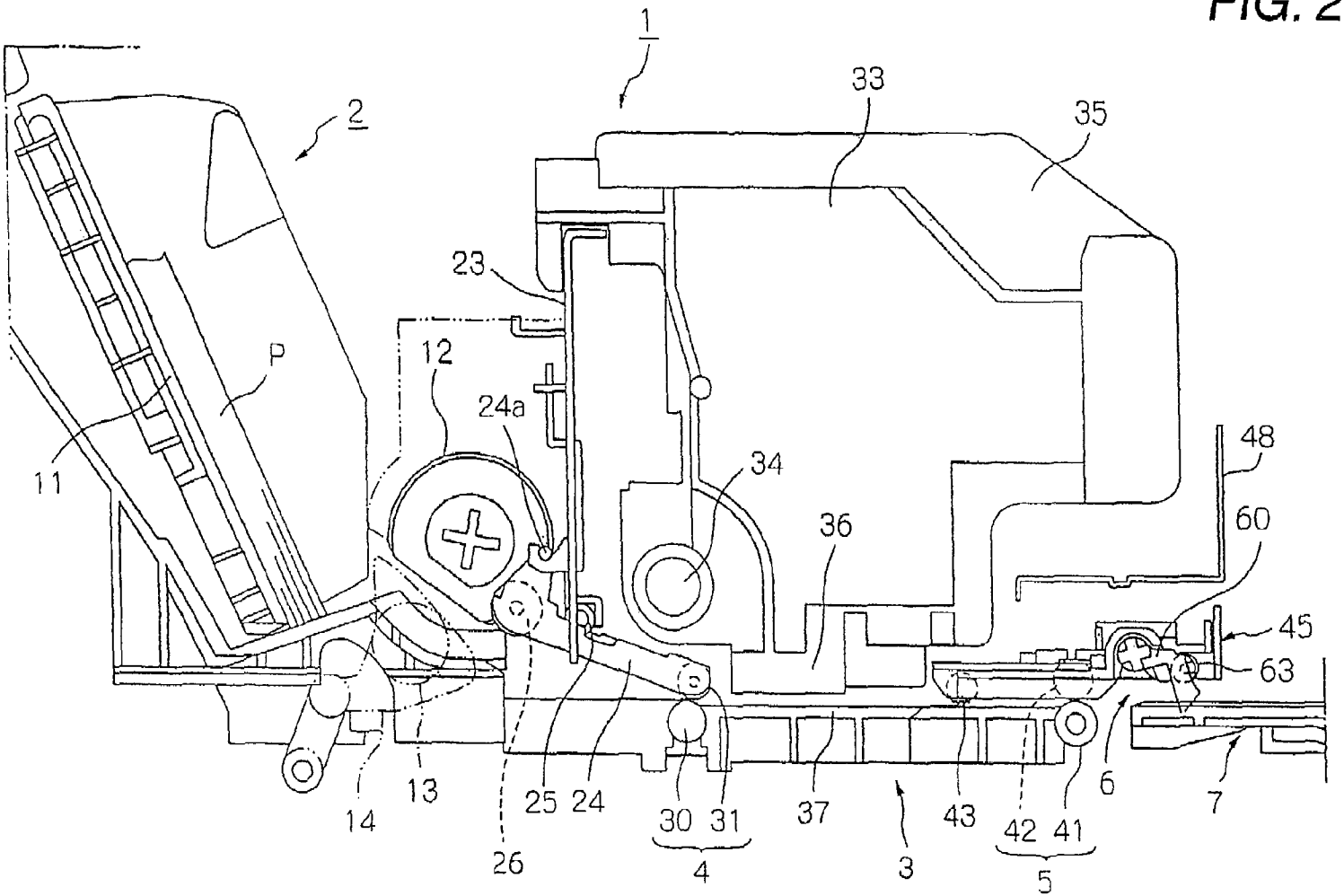
FIG. 2 is a schematic section view of the ink jet printer of FIG. 1.

An ink jet printer (hereinafter simply called a "printer") 1, which is employed as an example of a recording apparatus or a liquid ejecting apparatus, will be described as a first embodiment. In the following description, the right direction (the front side of the printer) in FIG. 2 will be referred to as "downstream" relative to a transporting direction of a recording medium (target medium). The left direction (the rear side of the printer) will be referred to as "upstream" relative to the transporting direction.

A feeder 2, into which recording media (target media) P in a cut-sheet form (hereinbelow referred to as "sheet P") can be set in an inclined posture, is provided in a rear section of the printer 1. A sheet P is fed from the feeder 2 to a transporter 4 located downstream. The thus-fed sheet P is transported downstream to a recording section 3 by the transporter 4, whereby recording is effected. The sheet P recorded by the recording section 3 or an optical disk D (a tray 50) is discharged forward of the recording apparatus by an ejector 5 located downstream. The transporter 4 and the ejector 5 also transport the tray 50 to be described later. The recording section 3 subjects the optical disk D which is set in the tray 50 also serves as a "recording medium" or a "target medium."

Constituent elements disposed in the medium transporting path of the printer 1 will be described in more detail. The feeder 2 is constructed of a hopper 11, a feeding roller 12, a retard roller 13, and a returning lever 14.

The hopper 11 is formed from a plate-shaped element and constructed to be able to pivot about a pivot center (not shown) provided in an upper part of the hopper 11. As a result of the hopper 11 pivoting, the inclined sheet P supported on the hopper 11 is brought into press contact with the feeding roller 12 or caused to retract from the feeding roller 12. The feeding roller 12 essentially assumes the shape of the letter D when viewed from the side. The feeding roller 12 feeds downstream the top sheet P, which remains in press contact with an arcuate portion of the D-shaped cross section of the feeding roller 12. During the course of the sheet P being transported by the transporter 4 after feeding of the sheet P, the transporter 4 is controlled such that a flat portion of the D-shaped cross section of the feeding roller 12 opposes the sheet P as illustrated, so as to prevent occurrence of transport load.

The retard roller 13 is provided so as to be able to come into press contact with the arcuate portion of the feeding roller 12. When overlapping transfer of the sheets P does not arise and only one sheet P is being fed, the retard roller 13 comes into contact with the sheet P to be thus rotated (clockwise in FIG. 2) When a plurality of the sheets P are present between the feeding roller 12 and the retard roller 13, the retard roller 13 does not rotate and remains stationary, because the frictional coefficient between the sheets P is lower than the frictional coefficient between the sheet P and the retard roller 13. Consequently, sheets P, which are subsequent to the top sheet P and are about to be delivered In an overlapping manner along with the top sheet P to be fed, do not proceed downstream from the retard roller 13, thereby preventing overlapped delivery of the sheets P. The returning lever 14 is pivotably provided and performs operation for returning to the hopper 11 sheets P, which are subsequent to the top sheet and have been prevented from being delivered in an overlapping manner.

A sensor (not shown) for detecting passage of the sheet P and a guide roller 26, which sets an attitude for feeding the sheet P and prevents the sheet P from contacting the feeding roller 12 to thus lessen transport load, are interposed between the feeding device 2 and the transporter 4. In the present embodiment, the guide roller 26 is rotatably supported by an upstream end of an upper guide 24.

The transporter 4 provided downstream of the feeder 2 comprises a transporting roller 30 rotationally driven by a motor and a transporting follower roller 31 which comes into press contact with the transporting roller 30 and rotates in a following manner. The transporting roller 30 is formed from an adhesion layer which is formed by dispersing, in an essentially uniform manner, wear-and-abrasion resistant particles over an outer peripheral surface of a metal shaft extending in the widthwise direction of the sheet. An outer peripheral surface of the transporting follower roller 31 is formed from low frictional material, such as an elastomer or the like A plurality of the transporting follower rollers 31 are provided around the transporting roller 30 in the axial direction thereof.

Figure 1:
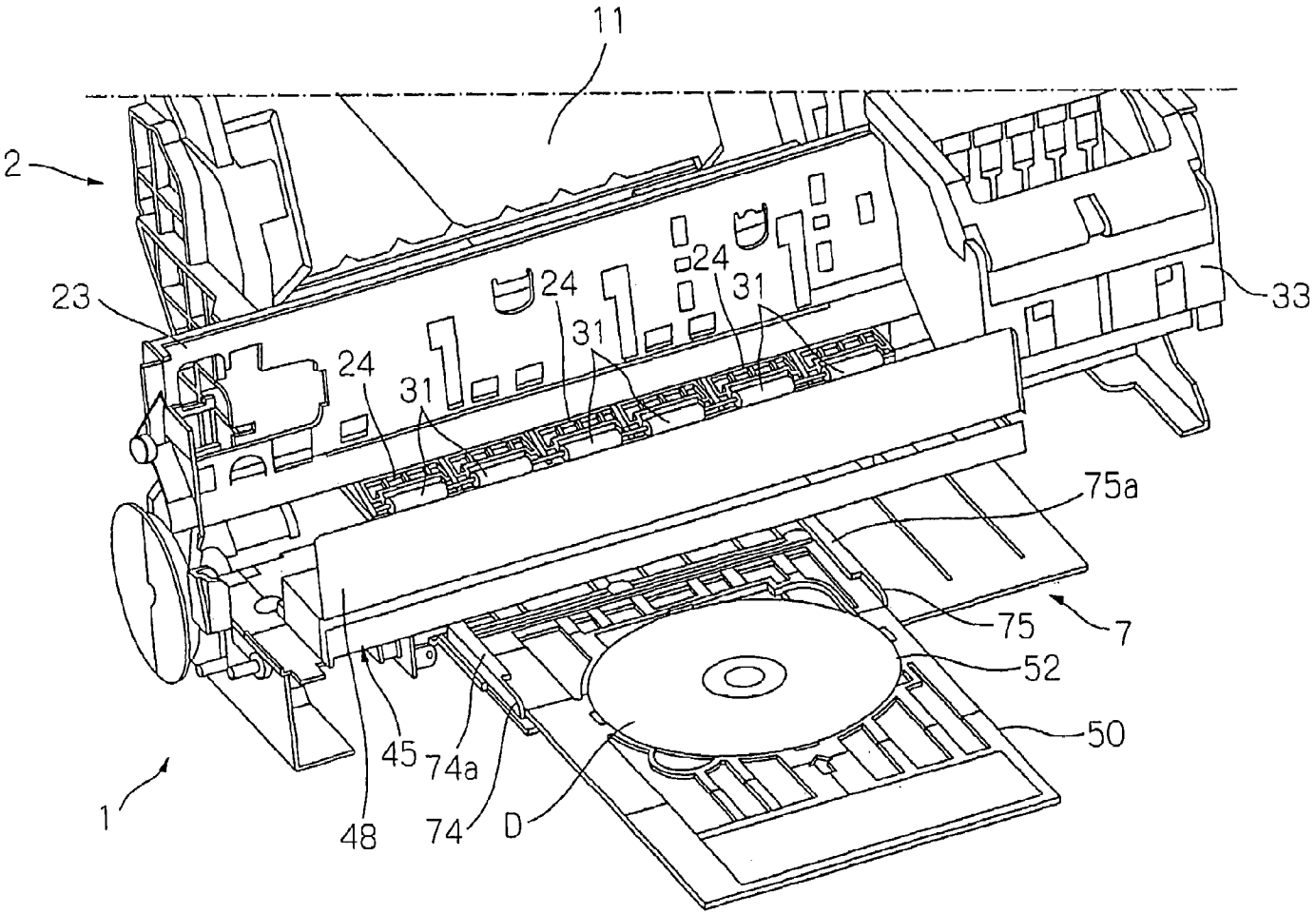
FIG. 1 is a perspective view of a front section of an ink jet printer according to a first embodiment of the invention.

In the present embodiment, two transporting follower rollers 31 are axially supported by a downstream end portion of one upper paper guide 24 so as to be able to freely rotate. As shown in FIG. 1, three transporting follower rollers 31 are arranged side by side on the paper guide 24 in the widthwise direction of the sheet A shaft 24*a* is axially supported by a main frame 23, and hence the sheet guide 24 is pivotable about the shaft 24*a* when the medium transporting path is viewed from the side. The transporting follower rollers 31 are urged by a coil spring 25 in a direction to come into press contact with the transporting roller 30.

The sheet P having reached the transporter 4 is transported to the recording section 3 located downstream, by rotation of the transporting roller 30, while being nipped between the transporting roller 30 and the transporting follower rollers 31.

The recording section 3 comprises an ink jet recording head (hereinafter referred to as a "recording head") 36 and a lower guide 37 provided so as to oppose the recording head 36. The recording head 36 is provided at the bottom of a carriage 33, and the carriage 33 is driven so as to move back and forth in the primary scanning direction by an unillustrated motor while being guided by a carriage guide shaft 34 extending in the primary scanning direction. The carriage 33 carries ink cartridges 35 of a plurality of colors which are independent of each other, and supplies ink to the recording head 36.

Ribs (not shown) and a recess (not shown), where ink is discarded, are formed on a surface of the lower guide 37 opposing the recording head 36, which defines a distance between the sheet P and the recording head 36. Ink ejected to an area outside the edges of the sheet P is discarded to the recess, thereby effecting so-called marginless printing where printing is carried out so as not to leave margins on the sheet P.

Subsequently, a guide roller 43 and the ejector 5 are provided downstream of the recording head 36. The guide roller 43 exhibits the function of preventing lift of the sheet P from the lower guide 37, to thus maintain the distance between the sheet P and the recording head 36 constant. The ejector 5 comprises an ejecting roller 41 to be rotationally driven by the unillustrated motor; and an ejecting follower roller 42 which comes into contact with the ejecting roller 41 and is rotated in a driven manner. In the present embodiment, the ejecting roller 41 is formed from a rubber roller, and a plurality of the ejecting rollers 41 are provided around a shaft element, which is rotationally driven, in an axial direction thereof (see FIG. 11).

The ejecting follower roller 42 is formed from a toothed roller having a plurality of teeth provided along an outer periphery thereof. A plurality of the ejecting follower rollers 42 are provided in a frame assembly 45, which is elongated in the primary scanning direction, so as to correspond to the plurality of ejecting rollers 41. The sheet P, on which information is recorded by the recording section 3, is rotationally driven by the ejecting rollers 41 while being nipped between the ejecting rollers 41 and the ejecting follower rollers 42, and is ejected forward of the recording apparatus to an ejected sheet stacker (not shown).

The frame assembly 45 is provided in such a way that the assembly can be displaced by a releaser 6 (described later) so as to be able to assume a contact position where the ejecting follower rollers 42 come into contact with the ejecting rollers 41, and a retracted position where the ejecting follower rollers 42 are retracted from the ejecting rollers 41.

The printer 1 is configured so as to be able to subject a label face of an optical disk such as a CD-R directly to ink jet recording, in addition to the recording medium of cut-sheet form. As shown in FIG. 1, the optical disk D is transported along a linear tray transporting path of the printer 1 while being mounted on the plate-shaped tray 50. The tray 50 is formed separately from the printer 1, and is manually inserted, toward the rearward direction (upstream) of the printer 1, into the tray transporting path while remaining supported by a tray guide 7 provided at the front of the printer 1.

The configuration of the tray 50 will be described hereunder by reference to FIGS. 3 and 4.

Figure 3:
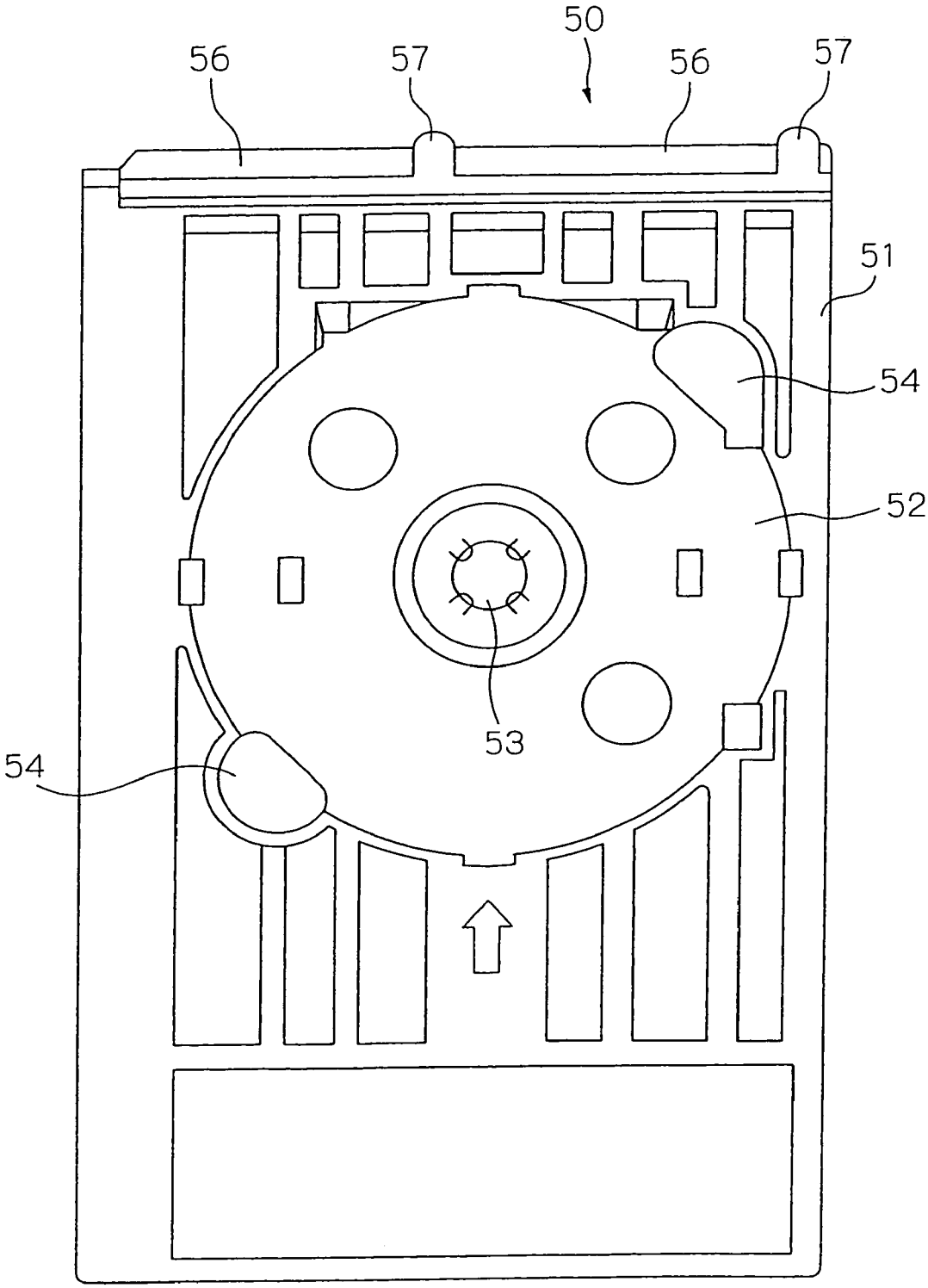
FIG. 3 is a plan view of a tray member to be inserted into the ink jet printer of FIG. 1.

As shown in FIG. 3, the tray 50 assumes a rectangular shape when viewed from above; forms the shape of a plate which enables nipping action by the transporting roller 30 and the transporting follower roller 31; and is able to effect feeding in the secondary scanning direction in association with rotation of the transporting roller 30.

The tray 50 is formed integrally from a resin material so as to have a tray body 51 and a disk holding section 52. As illustrated, the disk holding section 52 is formed by a recessed section having a circular shape when viewed from above. A protrusion 53 is formed in the center of the disk holding section 52. When the optical disk D is set in the disk holding section 52, the protrusion 53 fits into a center hole (not shown) of the optical disk D, whereby the position of the optical disk D in the disk holding section 52 is determined. Holes 54 formed in the perimeter of the disk holding section 52 are holes used for removing the optical disk D from the disk holding section 52.

The upper-lower direction of FIG. 3 corresponds to the transporting direction of the tray 50. The tray 50 is inserted (fed) into the transporting path of the tray 50 by way of the tray guide 7, an upper portion of the tray in FIG. 3 is inserted as a leading end. Specifically, reference numeral 56 designates the leading edge of the tray 50. As shown in FIG. 4, tabs 57 are formed integrally on the tray 50 so as to protrude in the inserting direction of the tray 50.

Figure 4:
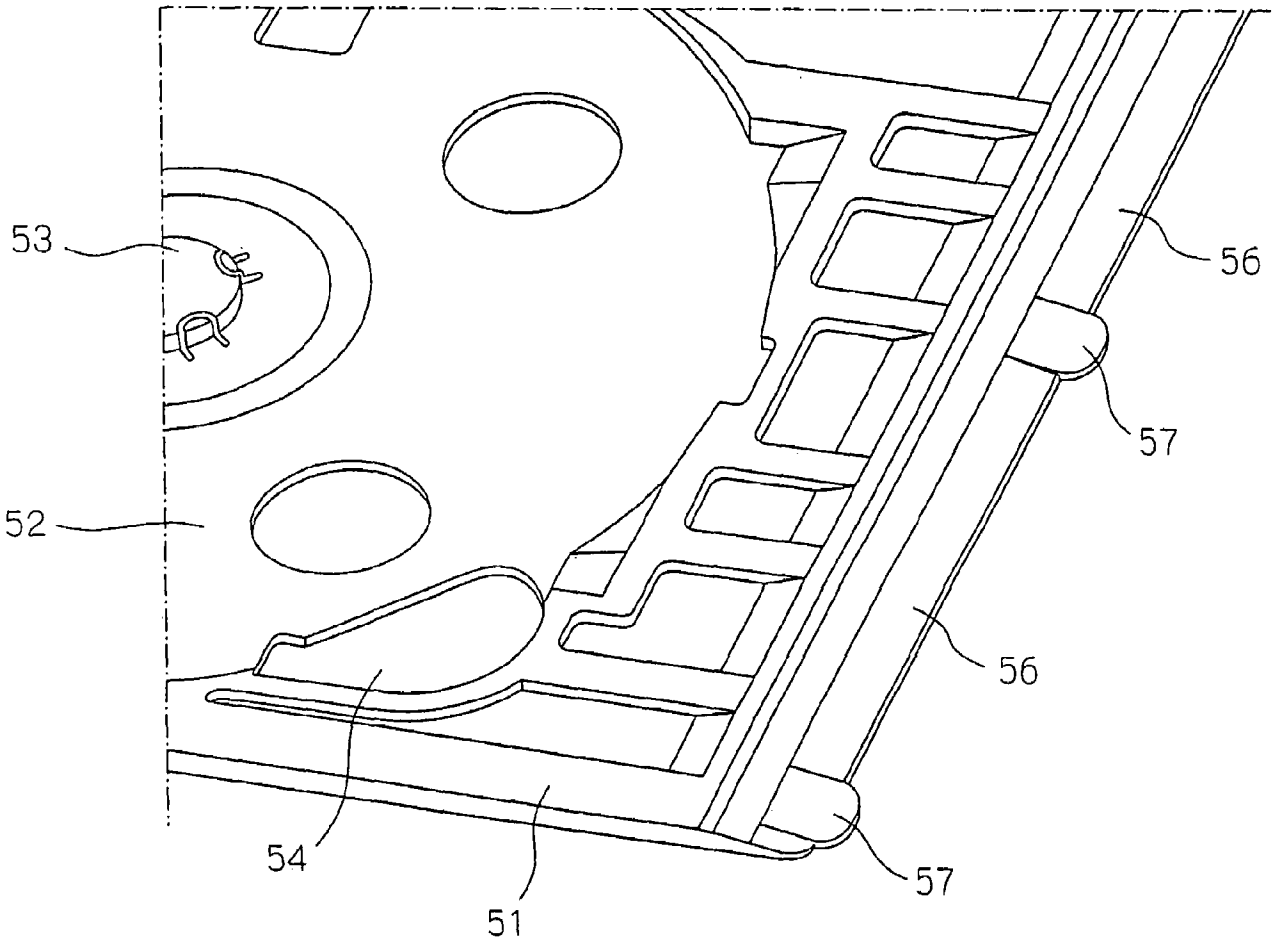
FIG. 4 is a perspective view of a leading end portion of the tray member.

As shown in FIG. 4, each of the tabs 57 is thinned toward the tip end thereof, and the bottom surface of the tab 57 is made flat and flash with the bottom surface of the tray body 51. Similarly, the leading edge 56 of the tray 50 is also formed so as to become thinned toward the front.

When the tray 50 is inserted into the transporting path of the tray 50, the leading edge 56 of the tray 50 is inserted rearward of the printer 1. At this time, the ejecting follower roller 42 is retracted from the ejecting roller 41 by the releaser 6 to be described later, and a press roller 63 (see FIG. 2) advances to the transporting path. The tray 50 is sandwiched between the ejecting roller 41 and the press roller 63 (when the transporting path is viewed from the side). When the ejecting roller 41 is rotationally driven in this state, the tray 50 is transported toward the transporter 4.

In order to feed the tray 50 in the secondary scanning direction by the transporting roller 30 and the transporting follower roller 31, the leading edge 56 of the tray 50 must be inserted between the transporting roller 30 and the transporting follower roller 31. Here, since the tabs 57 are formed at the leading edge 56 of the tray 50, the tabs 57 first enter between the transporting roller 30 and the transporting follower roller 31 when the tray 50 is transported toward the transporter 4 in association with rotation of the ejecting roller 41. The leading edge 56 of the tray 50 then enters between the transporting roller 30 and the transporting follower roller 31, and the tray 50 is nipped between the rollers.

Specifically, since the area of the leading end of the tray 50 (when viewed from above) is made much smaller by the tabs 57, the leading edge 56 of the small 50 can be readily caused to enter between the transport driver roller 30 and the transporting follower roller 31. Thus, the tray 50 can be caused to enter between the drive roller 30 and the transporting follower roller 31 without use of a special mechanism for retracting the transporting follower roller 31 from the transporting roller 30.

The frame assembly 45 and the releaser 6 for displacing the frame assembly 45 from the contact position to the retracted position will be described in detail.

Figure 5:
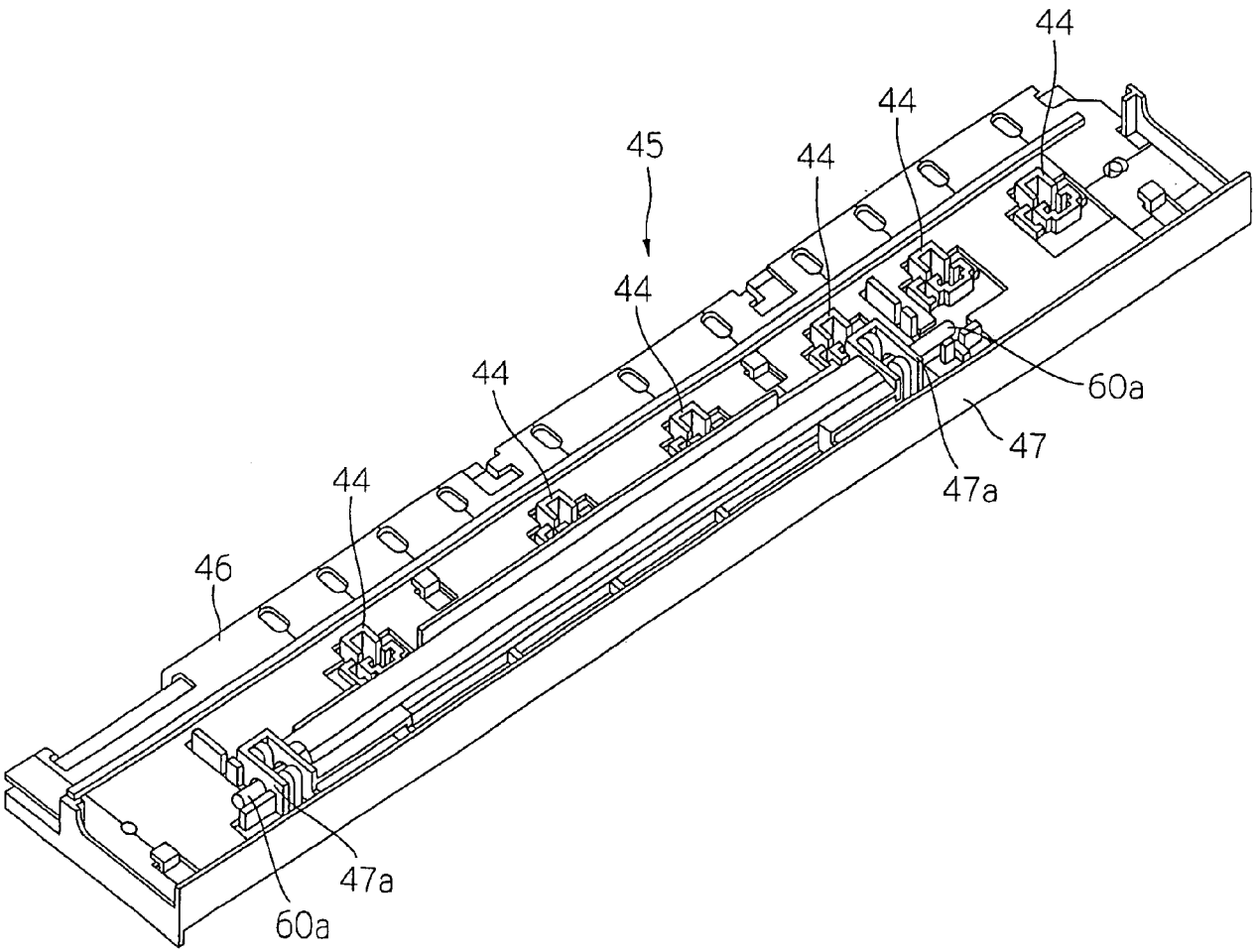
FIG. 5 is a top perspective view of a frame assembly of an ejector in the ink jet printer of FIG. 1.

As shown in FIG. 5, the frame assembly 45 comprises a frame 46 formed from a metal plate material, and a roller support 47 formed from resin material. The frame assembly 46 has a shape extending in the primary scanning direction (i.e., the widthwise direction of a sheet P).

Holders 44, each of which rotatably supports the ejecting follower roller 42, are integrally formed in the roller support 47. Bearings 47*a*, which rotatably support the releaser body 60 to be described later, are also formed integrally in the roller support 47.

Figure 6:
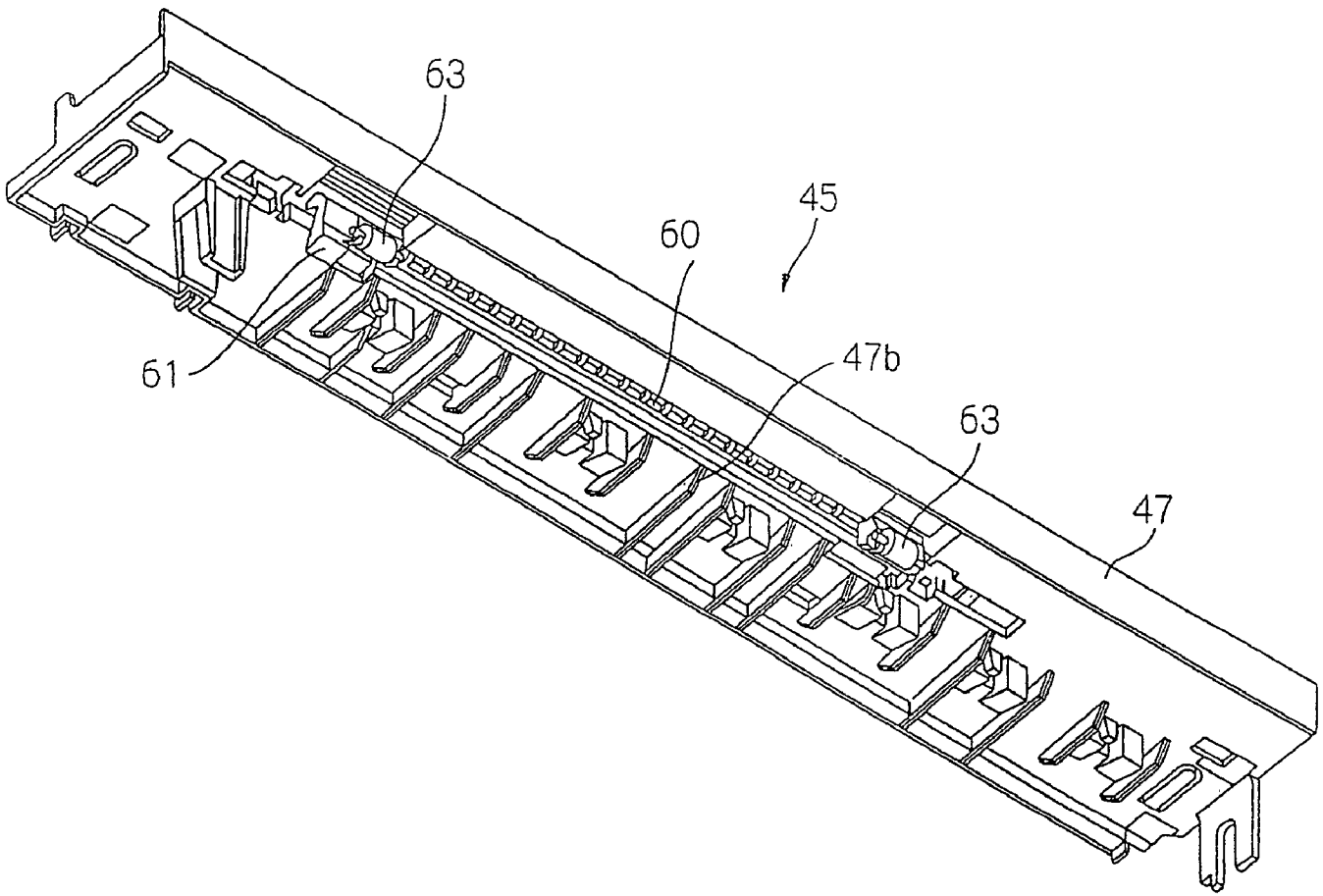
FIG. 6 is a bottom perspective view of the frame assembly.

Ribs 47*b* shown in FIG. 6 are guide ribs used for smoothly guiding the sheet P downstream when the sheet P is ejected.

Figure 7:
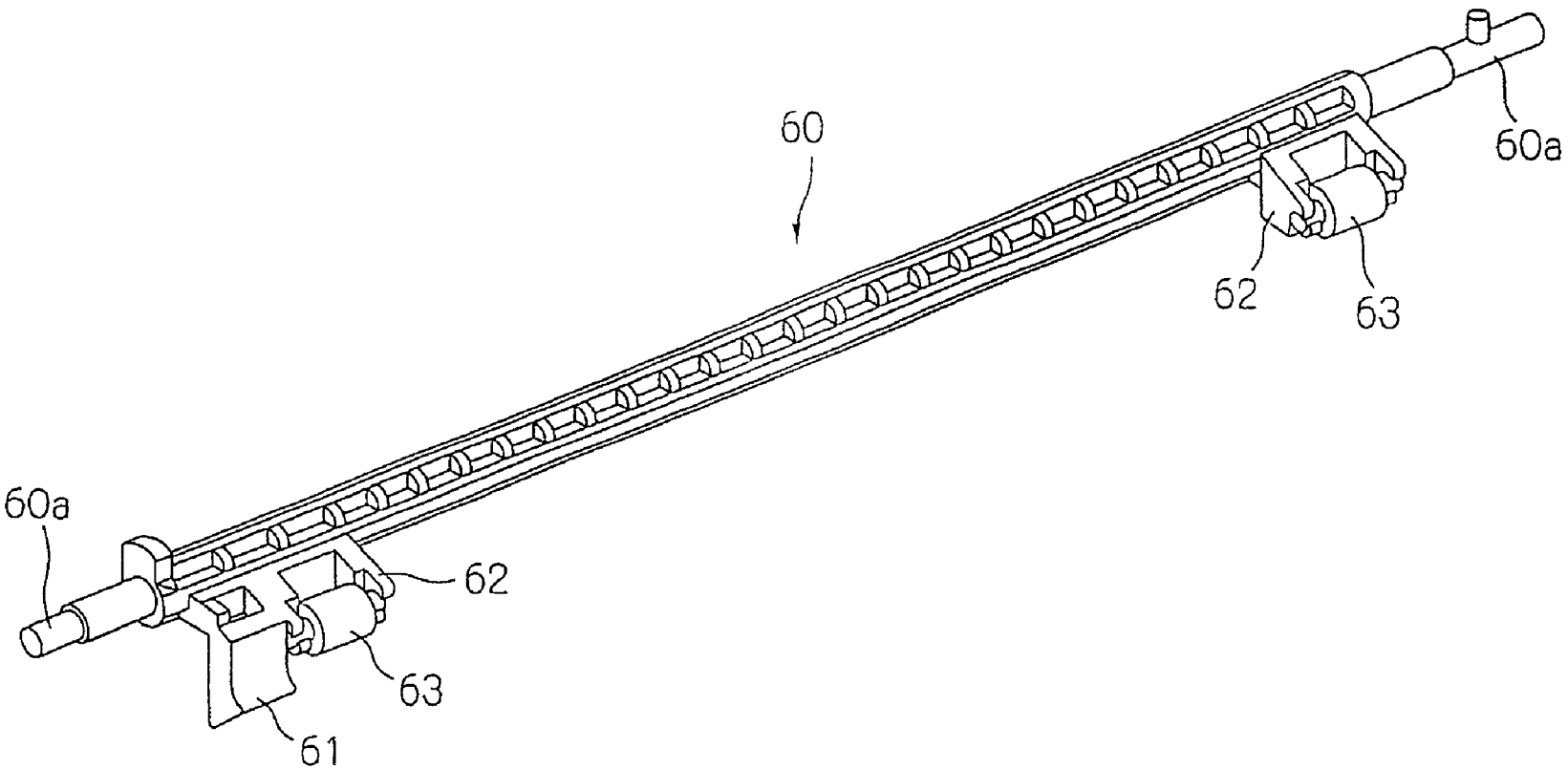
FIG. 7 is a perspective view of a releaser body incorporated in the frame assembly.
Figure 8:
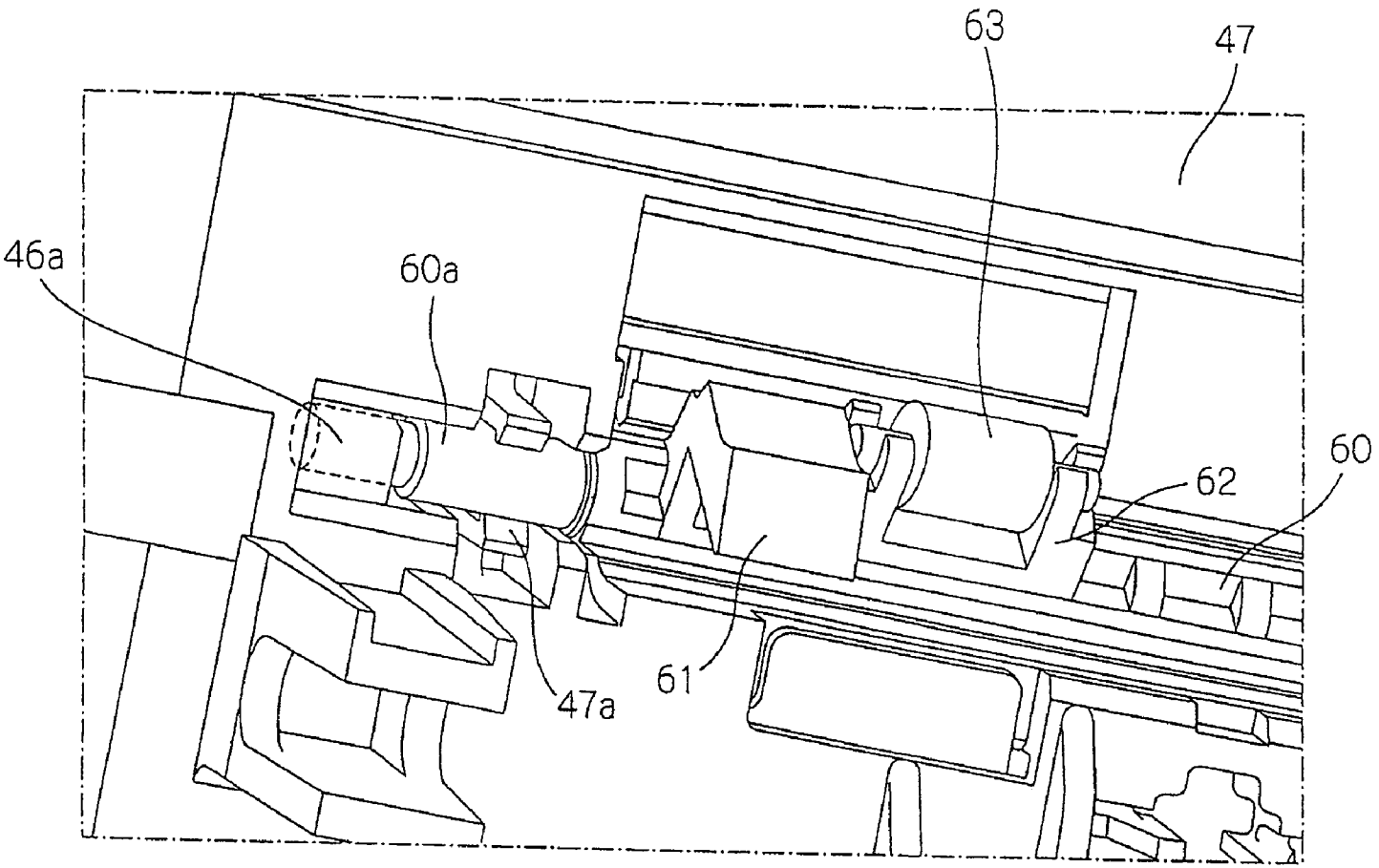
FIG. 8 is an enlarged perspective view of a longitudinal end portion of the releaser body, showing a state that the releaser body is fitted with the frame assembly.

As shown in FIG. 7, the releaser body 60 of the releaser 6 is formed from an axial element which extends in the primary scanning direction. As shown in detail in FIG. 8, shaft end 60*a* of the releaser body 60 are fitted to the bearings 47*a* by snap-fitting action. As shown in FIG. 8, the frame 46 is fitted to the roller support 47, so that a retainer 46*a* formed in the frame 46 reliably retains the shaft end 60*a* such that the shaft end 60*a* does not come off the bearing 47*a*.

As shown in FIGS. 7 and 8, a lever 61 is formed in the vicinity of one shaft end 60*a* of the releaser body 60. Moreover, the press rollers 63 formed from, e.g., a rubber roller are rotatably supported by bearings 62 which are in the vicinity of the lever 61 and the other shaft end 60*a*.

Operation of the releaser body 60 will be described hereinbelow particularly in connection with a relationship between the lever 61 and the press roller 63, by reference to FIGS. 9 and 10.

Figure 9:
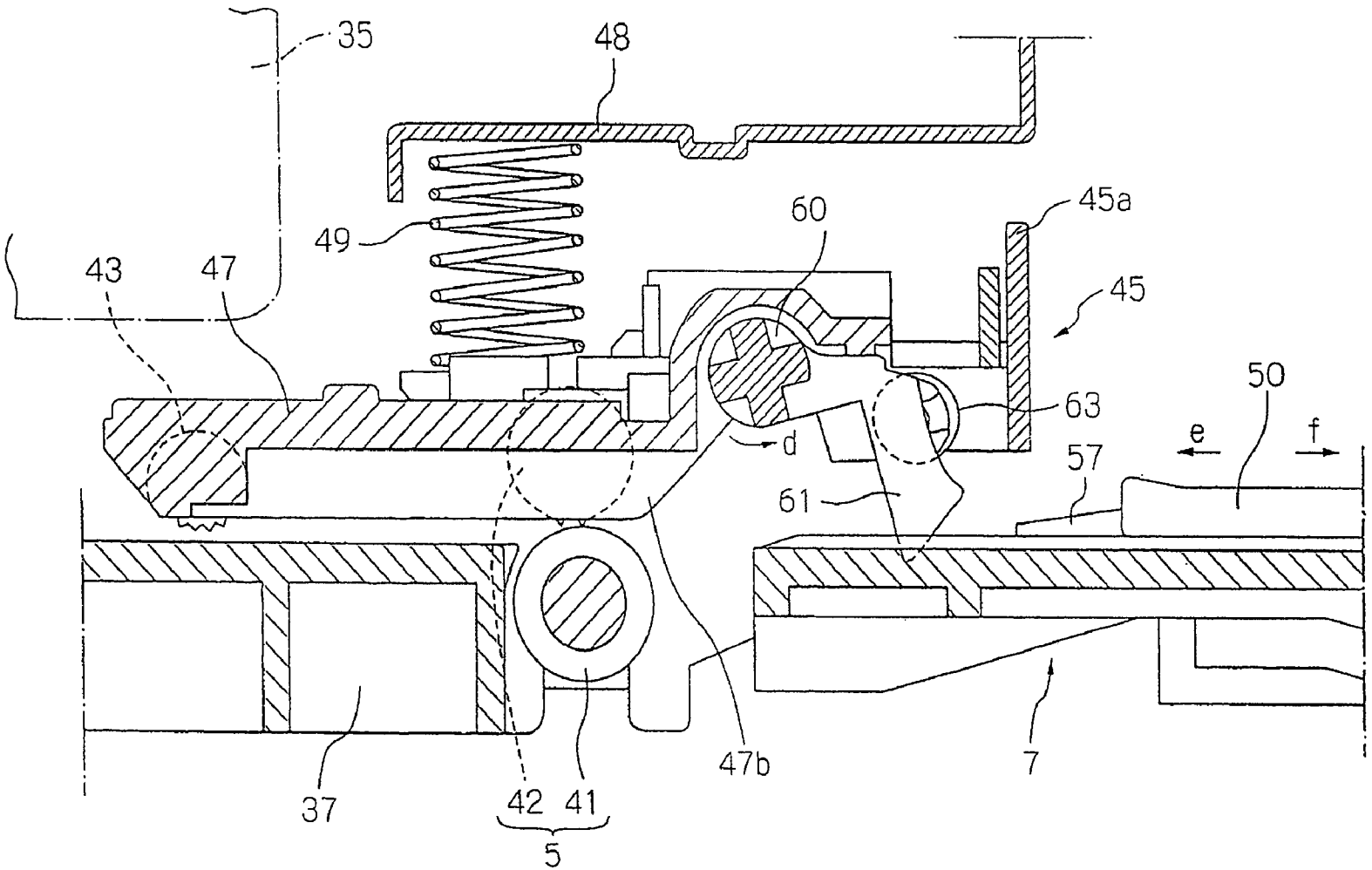
FIG. 9 is a schematic section view of the ejector in the ink jet printer of FIG. 1, showing a state that an ejecting follower roller comes in contact with an ejecting roller.

In FIG. 9, which shows the contact position of the frame assembly 45, the lever 61 protrudes into the transporting path of the tray 50 as illustrated, and the press roller 63 remains receded from the transporting path of the tray 50. The releaser body 60 is provided such that the lever 61 is urged so as to protrude into the transporting path of the tray 50 (the direction of arrow "d" in FIG. 9) by unillustrated urging member (e.g., a torsion spring).

Figure 10:
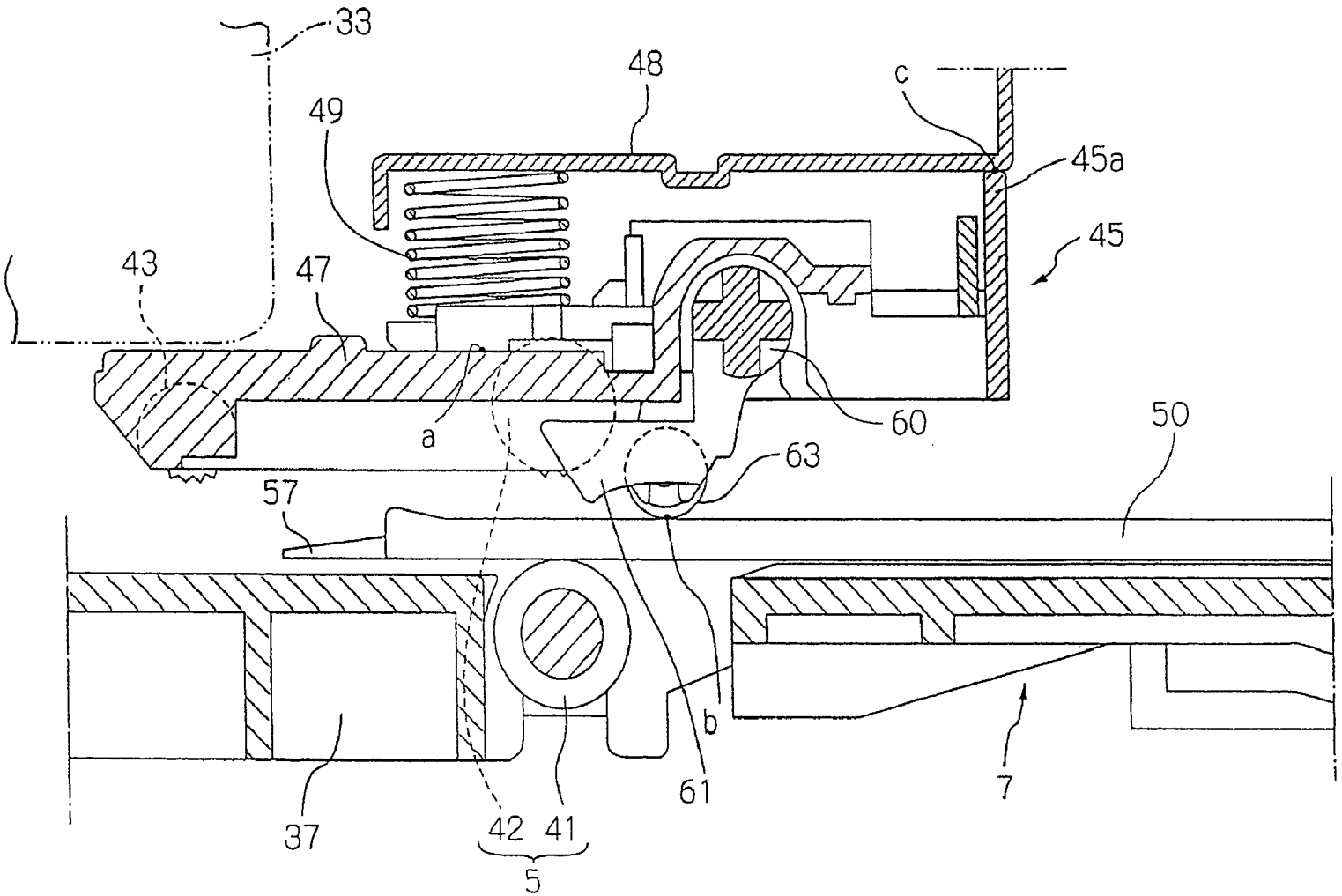
FIG. 10 is a schematic section view of the ejector in the ink jet printer of FIG. 1, showing a state that the ejecting follower roller is retracted from the ejecting roller.

In this state, when the tray 50 is manually inserted into the tray transporting path from the forward of the apparatus (i.e., a downstream position of the tray transporting path) to the rearward direction of the apparatus (i.e., an upstream position of the tray transporting path) in the direction of arrow "e" shown in FIG. 9, the tray 50 lifts the lever 61 as shown in FIG. 10. The releaser body 60 rotates, and the frame assembly 45 is upwardly displaced in association with rotation of the releaser body 60. As a result, the releaser body 60 being displaced upwardly, the frame 45 is displaced from the contact position to the retracted position.

A guide frame 48 is provided at a position above the frame assembly 45, and a projection 45*a* projecting toward the guide frame 48 is formed at a downstream end of the roller support 47. As shown in FIG. 10, as a result of the projection 45*a* coming into contact with a lower face of the guide frame 48 (a face opposing the frame assembly 45), the frame assembly 45 is positioned in the retracted position.

As shown in FIG. 10, the frame assembly 45 is retained in an essentially horizontal attitude in the retracted position. The reason for this is that a position above and upstream of the frame assembly 45 is a primary scanning area of the carriage 35 as illustrated. For instance, when the attitude of the frame assembly 45 becomes inclined such that the upstream side of the frame assembly 45 is oriented upward, the upstream end of the frame assembly 45 interferes with the carriage 35. Accordingly, as a result of the frame assembly 45 being held in the horizontal attitude in the retracted position as mentioned previously, occurrence of interference is prevented without greatly separating the frame assembly 45 from the carriage 35, which in turn prevents an increase in the size of the apparatus.

A coil spring 49 is interposed between the frame assembly 45 and the guide frame 48, and imparts urging force such that the upstream side of the frame assembly 45 is retracted from the guide frame 48. The urging force of the coil spring 49 acts so as to generate a pressing force, by which the press roller 63 presses the tray 50 toward the ejecting roller 41, and compressing force for bringing the projection section 45*a* into press contact with the guide frame 48. Specifically, as shown in FIG. 10, according to the principle of a lever consisting of a power point "a", a fulcrum "b", and a working point "c", the frame assembly 45 can stably hold the retracted position, and the tray 50 can be reliably pressed toward the ejecting roller 41.

As has been described above, since the frame assembly 45 is displaced to the retracted position by rotation of the releaser body 60, a large release stroke of the frame assembly 45 can be ensured. Further, in comparison with the case of adoption of a link mechanism or the like, the releaser 6 can be constituted at low cost without involvement of an increase in the number of components. Further, as a result of the tray 50 being inserted into the transporting path, the tray 50 displaces by itself the frame assembly 45 from the contact position to the retracted position. Therefore, the ejecting follower roller 42 can be reliably retracted from the ejecting roller 41 without involvement of a necessity for special operation. Moreover, since the tray 50 is pressed by the press roller 63 toward the ejecting roller 41, lifting of the tray 50; i.e., occurrence of contact between the optical disk D set In the tray 50 and the ejecting follower roller 42, can be prevented reliably. Moreover, since the press roller 63 is freely rotatable, the transport load arising during transport of the tray 50 can be minimized.

As indicated by a change from FIG. 9 to FIG. 10, the press roller 63 advances into the transporting path in association with receding operation of the lever 61 from the transporting path, to thereby press the tray 50 toward the ejecting roller 41. Consequently, the tray 50 is sandwiched between the ejecting roller 41 and the press roller 63 (when the transporting path is viewed from the side).

By rotation of the ejecting roller 41, the tray 50 is transported upstream. According to the tabs 57 formed at the leading end of the tray 50, the leading edge 56 of the tray 50 smoothly enters between the transporting roller 30 and the transporting follower roller 31, whereby the tray 50 becomes nipped between the transporting roller 30 and the transporting follower roller 31. In subsequent operation, the tray 50 is fed downstream in the secondary scanning direction by rotation of the transporting roller 30. The recording head 36 performs recording of information onto the optical disk D.

When the tray 50 is ejected in the direction of arrow "f" in FIG. 9, the releaser body 60 is urged so as to pivot in the direction of arrow "d." Therefore, the lever 61 acts so as to push the leading edge 56 of the tray 50 in the ejecting direction. The ease of output of the tray 50 is thus enhanced, so that the tray 50 can be ejected smoothly.

Figure 12:
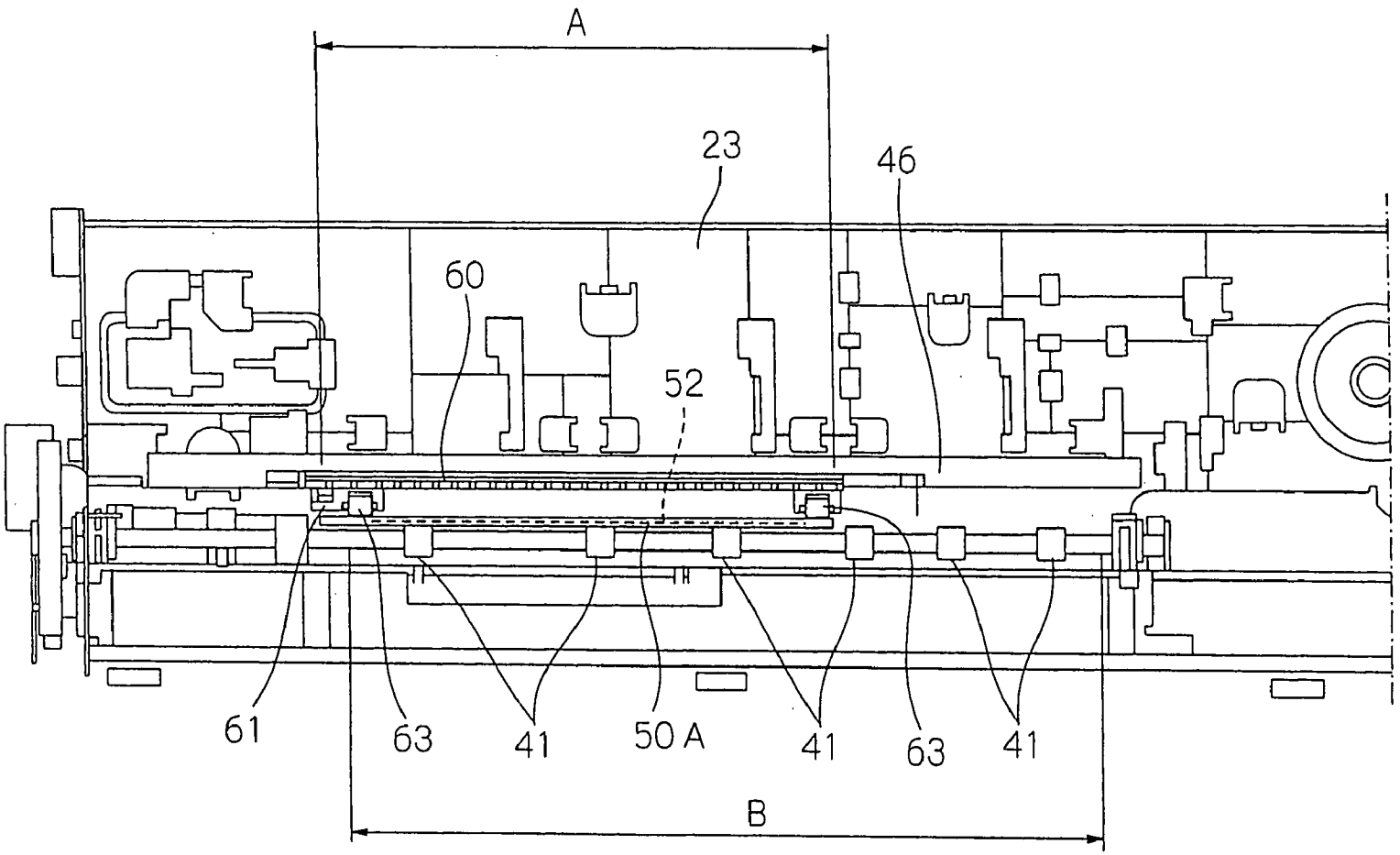
FIG. 12 is a front view of the front section of the ink jet printer of FIG. 11.

An area B in the primary scanning direction in FIG. 12 represents an area through which the sheet P passes, and an area A represents an area through which the tray 50 passes. As illustrated, the press rollers 63 are situated in the area B. As shown in FIG. 9, when the medium transporting path is viewed from the side, the press rollers 63 recede from the area where the sheet P passes in a case where the frame assembly 45 is placed in the contact position. Further, as shown in FIG. 10, the press rollers 63 advance into the area where the sheet P passes in a case where the frame assembly 45 is placed in the retracted position.

When the press roller 63 is placed outside of the area B where the sheet P passes, so as not to obstruct passage of the sheet P, the widthwise dimension of the area A; namely, the widthwise dimension of the tray 50, becomes greater accordingly. However, the press rollers 63 are located within the area B where the sheet P passes in the primary scanning direction, whereby an increase in the widthwise dimension of the tray 50 can be prevented. In a state where the sheet P passes (i.e., the contact position of the frame assembly 45 shown in FIG. 9), the press rollers 63 recede from the passage area of the sheet P, and hence passage of the sheet P is not obstructed.

A plurality of press rollers 63 (two press rollers in the present embodiment) are provided. As shown in FIG. 12, the positions of the press rollers 63 become symmetrical about the center of the tray 50 in the primary scanning direction (located in the vicinity of both ends of the tray 50 in the present embodiment). Therefore, when the tray 50 is transported by the press rollers 63 and the ejecting roller 41, the tray 50 can be transported appropriately without inducing a skew.

Subsequently, there will be described erroneous insert prevention means for preventing insertion of the tray 50 from an erroneous position when the frame assembly 45 is located in the contact position.

As shown in FIG. 1, guide ribs 74, 75 are formed on the tray guide 7. The guide ribs 74, 75 are provided on respective side edges of the tray 50, to thus regulate the positions of the side edges of the tray 50. The guide rib 74 has a hood section 74*a*, and the guide rib 75 has a hood section 75*a*. These hood sections 74*a*, 75*a* perform the function of preventing lifting of the tray 50 from the tray guide 7.

In a case where the tray 50 is not correctly set by way of the guide ribs 74, 75; for instance, where the tray 50 is set such that one of the side edges of the tray 50 runs onto an upper portion of the hood section 74*a* or 75*a* and is inserted in its present form into the apparatus, if the leading edge of the tray 50 pushes the releaser body 60 upward, the frame assembly 45 will be displaced from the contact position to the retracted position. Therefore, there may arise a case where the tray 50 is inserted into the apparatus while remaining lifted from the tray guide 7, to thus induce a problem of the optical disk CD set on the tray 50 coming into contact with the ejecting follower roller 42 or a problem of the leading edge of the tray 50 breaking constituent elements in the apparatus.

However, when the side edge of the tray 50 has run on the upper portion of the hood section 74*a* or 75*a*, the leading edge of the tray 50 performs the function of guiding the leading edge of the tray 50 so as to come into contact with the roller support 47. Consequently, even when the tray 50 is inserted while not being guided properly, the leading edge of the tray 50 contacts the roller support 47, whereupon further advancement of the leading edge is prevented. Namely, the frame assembly 45 is not displaced from the contact position to the retracted position, thereby preventing occurrence of a failure, which would otherwise be caused as a result of erroneous insertion of the tray 50.

Next, a second embodiment of the present invention will be described by reference to FIGS. 11 to 15. Components similar to those in the first embodiment will be designated by the same reference numerals and repetitive explanations for those will be omitted.

As mentioned previously, the press rollers 63 advance into the tray transporting path in association with receding action of the ejecting follower roller 42 as indicated by a change from FIG. 9 to FIG. 10, to thus press the tray 50 toward the ejecting roller 41. Accordingly, the tray 50 is brought into a transportable state by rotation of the ejecting roller 41. In the first embodiment, the tray 50 is transported to the transporter 4 located upstream, by rotating the ejecting roller 41 in this state. During actual recording operation, the tray 50 is fed in the secondary scanning direction by the transporter 4. However, in the present embodiment, even at the time of actual recording operation, the tray 50 is fed in a secondary scanning direction without use of the transporter 4, by rotation of only the ejecting roller 41 (the transporter 4 is not used). Specifically, the ejecting roller 41 and the press roller 63 serve a tray transporter which feeds the tray 50A in the secondary scanning direction.

Figure 13:
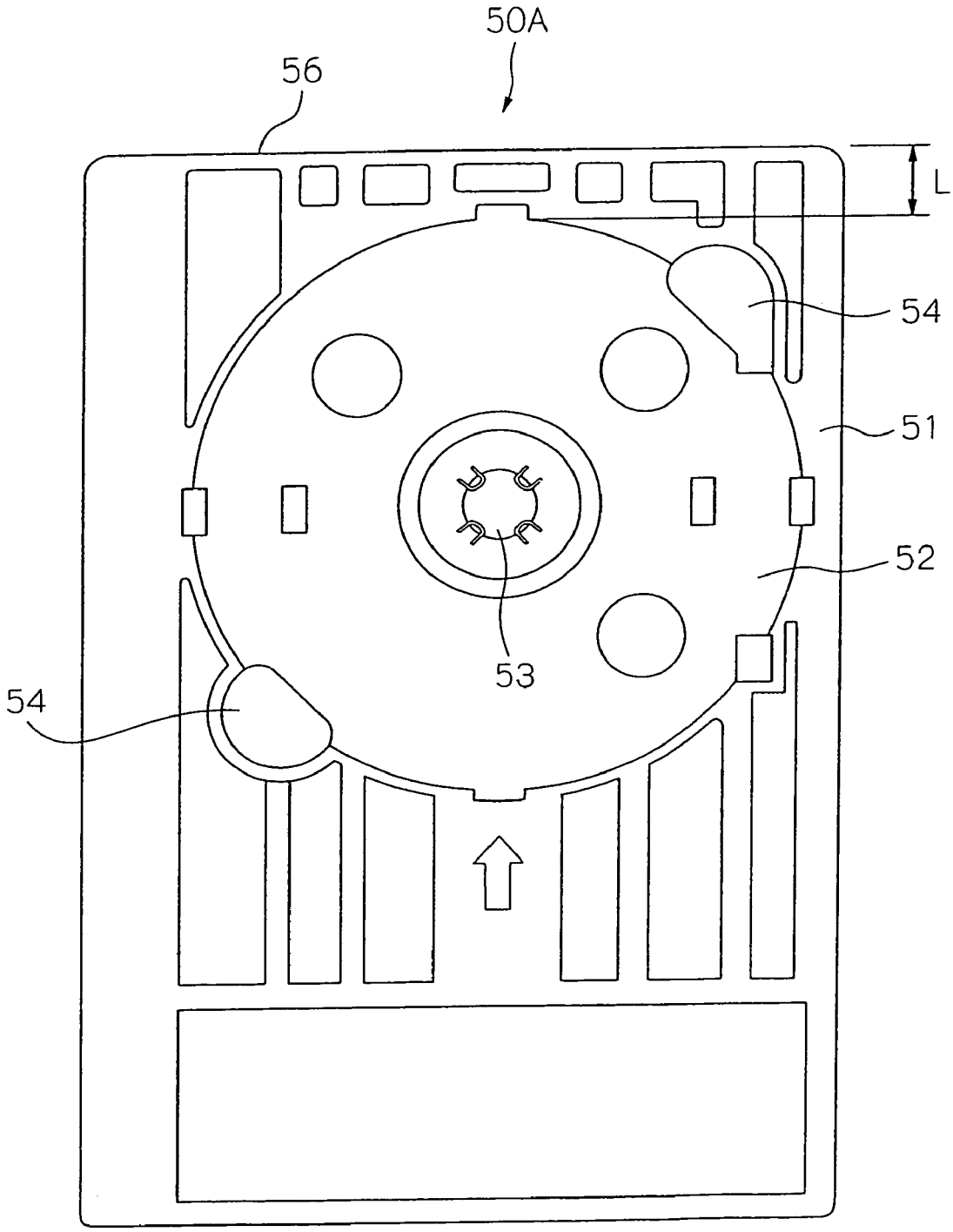
FIG. 13 is a plan view of a tray member to be inserted into the ink jet printer of FIG. 11.
Figure 14:
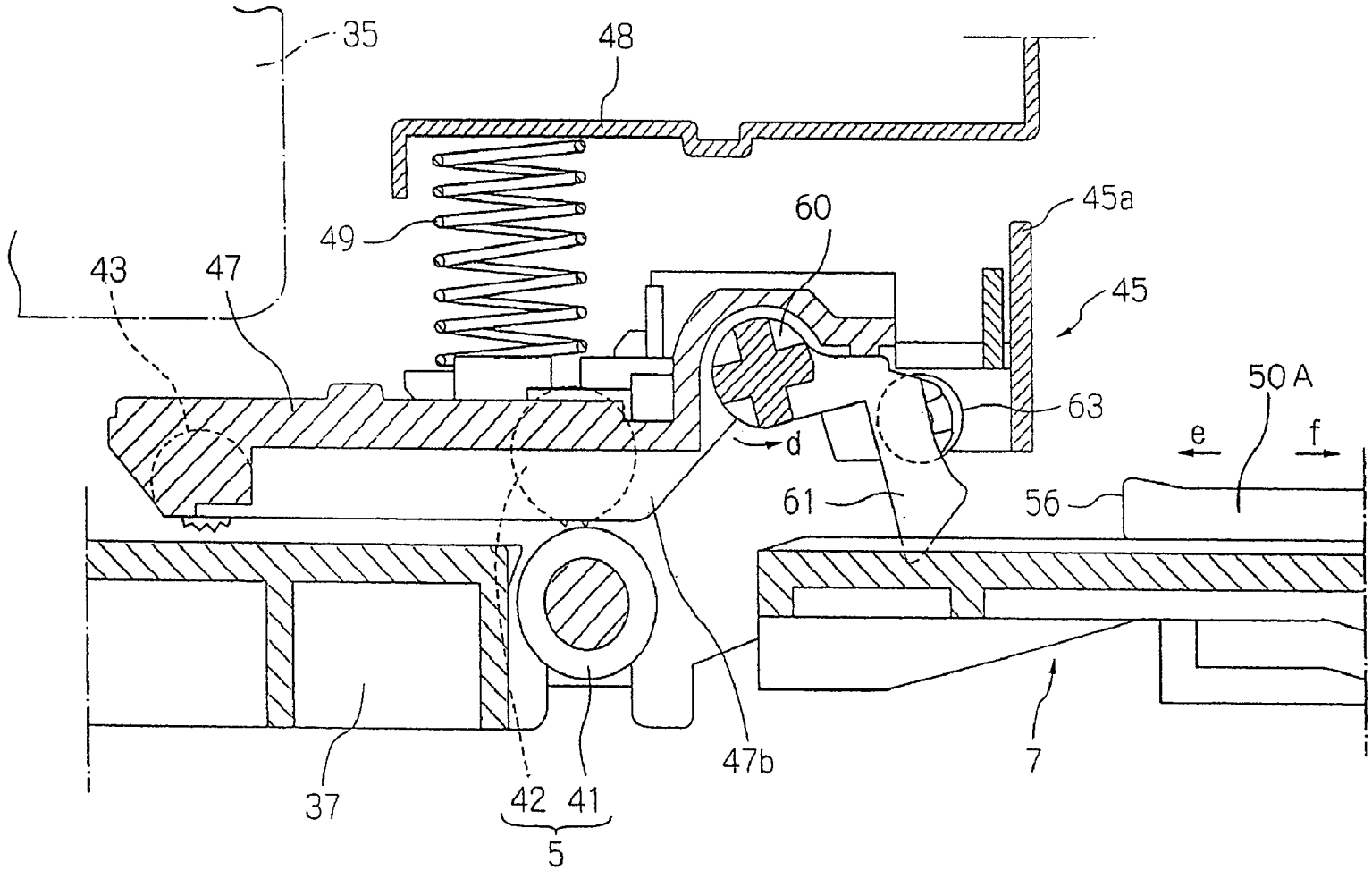
FIG. 14 is a schematic section view of an ejector in the ink jet printer of FIG. 11, showing a state that an ejecting follower roller comes in contact with an ejecting roller.
Figure 15:
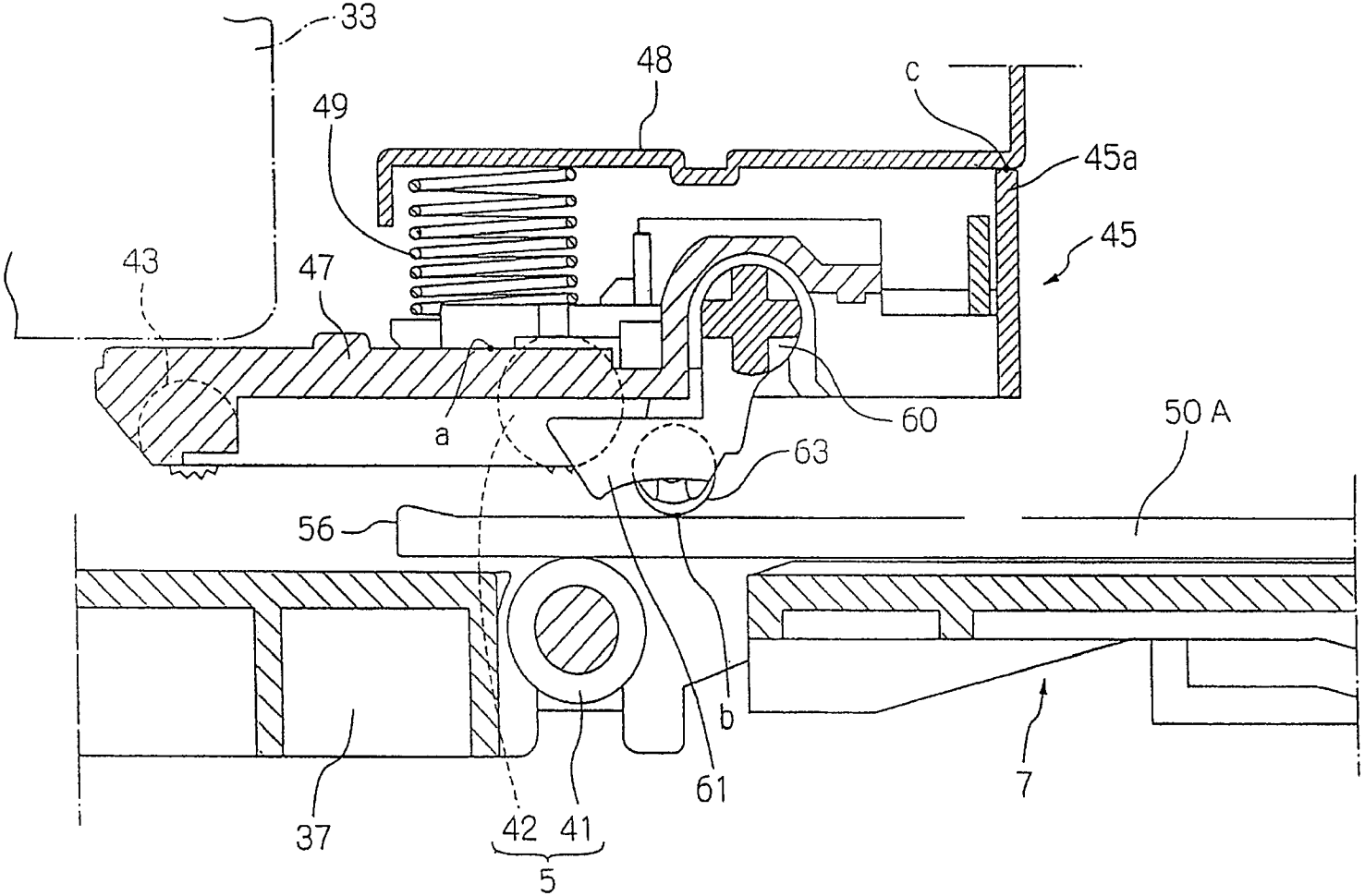
FIG. 15 is a schematic section view of the ejector in the ink jet printer of FIG. 11, showing a state that the ejecting follower roller is retracted from the ejecting roller.

As shown in FIGS. 13 and 14, when the tray 50A is inserted into the transporting path for the tray 50A, the leading edge 56 of the tray 50A is inserted rearward into the printer 1 by way of the tray guide 7 while the leading edge 56 is taken as a head. At this time, as mentioned previously, the ejecting follower roller 42 is retracted from the ejecting roller 41 by the releaser 6, and the press rollers 63 advance into the transporting path. The tray 50A is sandwiched between the ejecting roller 41 and the press rollers 63 (when the transporting path is viewed from the side). As a result of the ejecting roller 41 being rotationally driven in this state, the tray 50A is transported.

Figure 11:
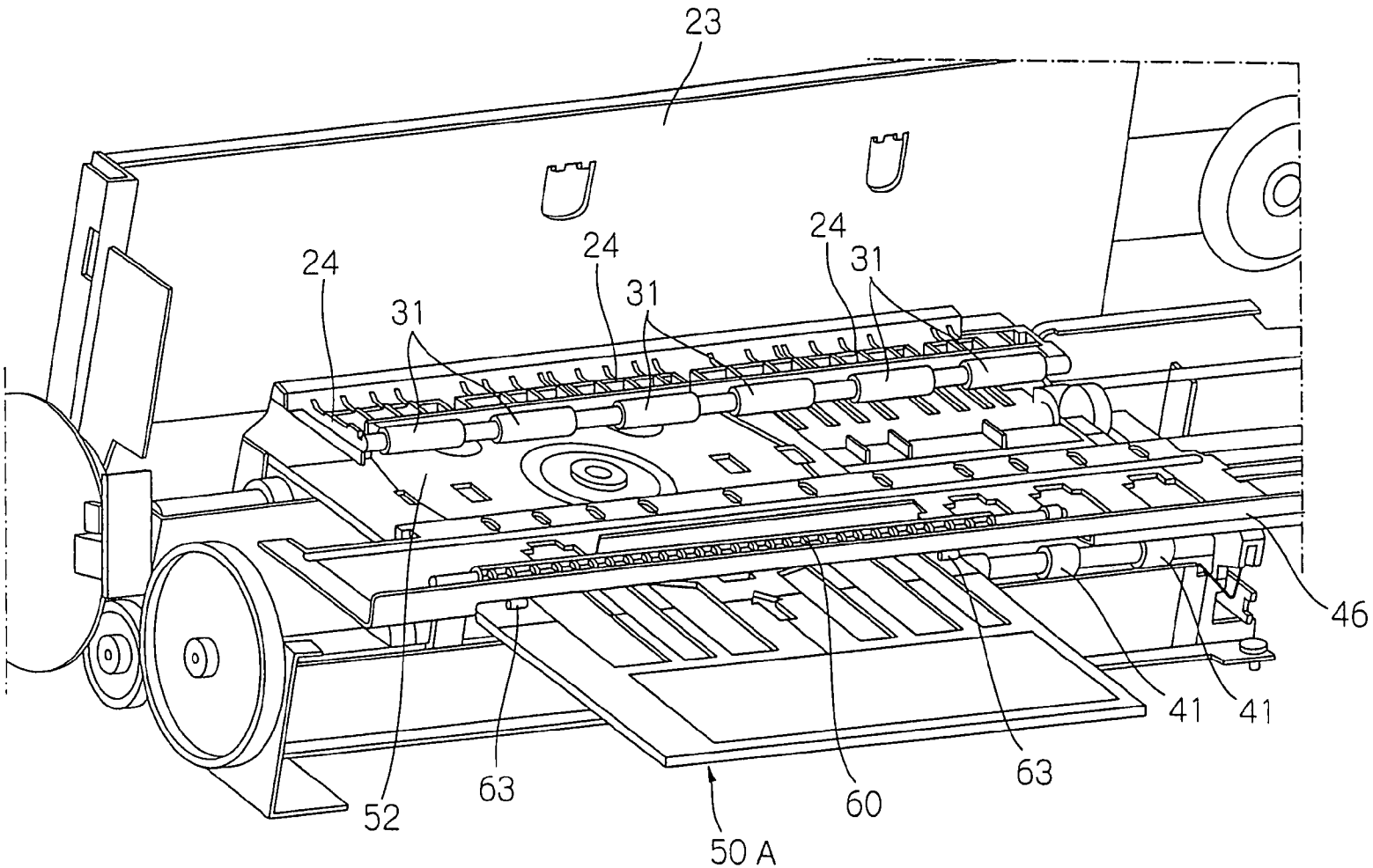
FIG. 11 is a perspective view of a front section of an ink jet printer according to a second embodiment of the invention.

The press rollers 63 are disposed on the recording face side of the optical disk D. As shown in FIGS. 11 and 12, the press rollers 63 are arranged so as to come into contact with the area of the tray 50A (the tray body 51) other than the disk holding section 52. Specifically, the tray transporter that transports the tray 50A is located on the recording face side of the optical disk D, and has first rollers (the press rollers 63) which come into contact with the area of the tray body 51 except the disk holding section 52 and a second roller (the ejecting roller 41) which comes into contact with a face of the tray body 51 opposite the face thereof which the first rollers are to contact.

Consequently, a passage trace of the rollers is not left on the recording face of the optical disk D set on the tray 50A, so that a superior recording result can be maintained. In addition, when the rollers pass by the disk holding section 52 of the tray 50A, the rollers pass over a stepped shape of the disk holding section 52, which may in turn adversely affect the accuracy of transport. However, as mentioned previously, the tray transporter contacts the area other than the disk holding section 52. Therefore, occurrence of a decrease in the accuracy of transport, such as that mentioned previously, can be prevented.

Since the transporter 4 is not utilized, no consideration must be paid to the accuracy of transport of the cut-sheet form medium (particularly, a custom-designed glossy sheet, or the like, used for effecting super-high quality printing equivalent to a silver-salt picture). Pressing force of the press rollers 63 used for pressing the tray 50A can be readily made optimal. Consequently, infliction of damage to the tray 50A, which would be induced by forceful pressing of the tray 50A, can be prevented. Further, the transporting roller 30 has the adhesion layer formed by essentially, uniformly dispersing abrasion-resistant particles around the peripheral surface of the metal shaft, as mentioned previously. Accordingly, infliction of damage to the tray 50A, which would be caused when the tray 50A is transported by such a transporting roller 30, can be prevented.

In addition, the tray 50A is manually inserted from the front side of the printer 1. However, the leading edge of the tray 50A does not need to be nipped by the transporter 4 during recording of information onto the optical disk D. Consequently, there can be employed a configuration where the dimension of the leading edge of the tray 50A (i.e., the distance from the area of the disk holding section 52 to the leading edge thereof; indicated by reference symbol L) is made shorter. Thus, an attempt can be made to miniaturize the tray.

In the embodiment, when recording of information onto the optical disk D is commenced, the leading edge of the tray 50A is located in a further upstream position with reference to the transporter 4. Therefore, there is provided a releaser (not shown) for retracting the transporting follower roller 31 from the transporting roller 30.

In the present embodiment, the tray transporter that transports the tray 50A has the press rollers 63 and the ejecting roller 41. However, the tray transporter may be constituted of the transporting roller 30 and the transporting follower roller 31. In other words, so long as the transporting follower roller 31 is placed so as to contact the area of the tray 50A except the disk holding section 52, the passage trace of the rollers is not left on the recording face of the optical disk D set on the tray 50A. A superior recording result can be maintained.

The object to be transported is not limited to the above-described tray 50A. For example, any medium may be employed, so long as the medium is plate-shaped and having great rigidity; e.g., cardboard or the like.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A liquid ejecting apparatus, comprising:

a transporting path including: a first region configured to transport a first target medium in a first direction, and a second region configured to transport a second target medium in the first direction and a second direction opposite to the first direction;

a liquid ejecting head, configured to eject liquid droplets toward the first target medium and the second target medium;

a first roller and a second roller, disposed in a downstream side of the liquid ejecting head relative to the first direction, and configured to nip the first target medium therebetween;

a supporting member, supporting the second roller and movable between a first position at which the second roller comes in contact with the first roller and a second position at which the second roller is separated from the first roller; and a releaser, rotatably supported on the supporting member and operable to move the supporting member between the first position and the second position in accordance with the rotation thereof, the releaser comprising a lever which is projected into not the first region but the second region of the transporting path when the supporting member is placed in the first position, wherein the lever is adapted configured to be pushed by a leading edge of the second target medium transported in the second direction, thereby receding from the transporting path and rotating the releaser in a such a direction that the releaser moves the supporting member to the second position.

2. The liquid ejecting apparatus as set forth in claim 1, further comprising an urging member, which urges the releaser so as to rotate in such a direction that the releaser moves the supporting member to the first position.

3. The liquid ejecting apparatus as set forth in claim 1, wherein the releaser comprises at least one pressing member configured to press the second target medium toward the first roller when the supporting member is placed in the second position.

4. The liquid ejecting apparatus as set forth in claim 3, wherein:

the press member projects toward the first region of the transporting path when the lever recedes from the transporting path; and the press member recedes from the transporting path when the lever project toward the transporting path.

5. The liquid ejecting apparatus as set forth in claim 3, wherein the press member is a roller.

6. The liquid ejecting apparatus as set forth in claim 3, wherein a plurality of press members are arranged in a third direction perpendicular to the first direction and the second direction, so as to be symmetrical with a center of the second target medium relative to the third direction.

7. The liquid ejecting apparatus as set forth in claim 4, wherein the press member is disposed at an area in which the first target medium passes when the lever projects into the transporting path.

8. The liquid ejecting apparatus as set forth in claim 1, wherein the releaser comprises a regulator, which regulates an attitude of the supporting member to be horizontal.

9. The liquid ejecting apparatus as set forth in claim 8, wherein:

the regulator comprises a positioning member having a stopper face facing the supporting member, and a projection provided on the supporting member projecting toward the stopper face; and the projection is abutted against the stopper face, thereby defining the second position of the supporting member.

10. The liquid ejecting apparatus as set forth in claim 9, wherein the regulator comprises an urging member which urges the projection toward the stopper face.

11. The liquid ejecting apparatus as set forth in claim 1, wherein the releaser is disposed in a downstream side of the second roller relative to the first direction.

12. The liquid ejecting apparatus as set forth in claim 1, further comprising a stopper which prevents the second target medium from entering the transporting path when the supporting member is placed in the first position.

13. The liquid ejecting apparatus as set forth in claim 1, wherein the second target medium is transported while being mounted on a tray.

* * * * *

UNITED STATES PATENT AND TRADEMARK OFFICE

CERTIFICATE OF CORRECTION

PATENT NO. : 7,591,552 B2
APPLICATION NO. : 11/336598
DATED : September 22, 2009
INVENTOR(S) : Takeshita et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 381 days.

Signed and Sealed this

Twenty-first Day of September, 2010

David J. Kappos

David J. Kappos
*Director of the United States Patent and Trademark Office*